US005192220A

United States Patent [19]

Billman et al.

[11] Patent Number: 5,192,220

[45] Date of Patent: Mar. 9, 1993

[54] DUAL READOUT EXTENDED SOCKET

[75] Inventors: Timothy B. Billman, King; Roger L. Thrush, Clemmons, both of N.C.

[73] Assignee: AMP Inc., Harrisburg, Pa.

[21] Appl. No.: 829,795

[22] Filed: Jan. 31, 1992

[51] Int. Cl.[5] ..... H01R 13/62

[52] U.S. Cl. ..... 439/327; 439/637

[58] Field of Search ..... 439/326–328, 439/630–637, 924, 59, 62, 60

[56] References Cited

U.S. PATENT DOCUMENTS 3,710,197 1/1973 Olds et al. ..... 439/924
4,550,959 11/1985 Grabbe et al. ..... 439/630
4,579,406 4/1986 Laursen et al. ..... 439/924
4,973,270 11/1990 Billman et al. ..... 439/630

FOREIGN PATENT DOCUMENTS 0026978 3/1978 Japan ..... 439/637
133999 2/1989 Japan ..... 439/60

*Primary Examiner*—David L. Pirlot

[57] ABSTRACT

An auxiliary socket (1) comprising, a housing (2) having multiple electrical terminals (3) in terminal receiving slots (4), the terminals (3) being relatively widely spaced apart, and a panel receiving slot (5) adapted for receiving circuit traces that are intolerant of relatively dense spacing with other circuit traces.

12 Claims, 6 Drawing Sheets

DUAL READOUT EXTENDED SOCKET

FIELD OF THE INVENTION

The invention relates to an extended socket for use as an auxiliary socket for a circuit panel, for example, a circuit panel of a Single In Line Memory Module, or SIMM.

BACKGROUND OF THE INVENTION

Disclosed in U.S. Pat. No. 4,973,270, is a SIMM socket with electrical terminals adapted for engaging circuit traces on opposite sides of a circuit panel of a single in line memory module or SIMM. The terminals of the SIMM socket have been designed to interconnect redundant circuits on both sides of the SIMM circuit panel.

Technical advances in the SIMM have resulted in the heretofore redundant circuit traces to become independent, whereby the circuit traces on one side of the SIMM circuit panel are independent of circuit traces on another side. In response to these technical advances, a dual readout SIMM socket has been developed.

U.S. patent application Ser. No. 572,196, discloses a dual readout SIMM socket with two rows of independent electrical terminals for engaging independent circuit traces routed on opposite sides of a SIMM circuit panel. The circuit panel of the SIMM is of low height. Panel support members of the socket project upwardly and support the panel when the panel is received by the socket. The circuit traces of the circuit panel are relatively densely spaced. The terminals of the SIMM socket are relatively densely spaced, and provide high density interconnections of the SIMM circuit traces and a circuit card to which the socket is mounted.

Further technical advances in the SIMM have increased requirements of some of the active circuit traces to carry increased signal frequencies and transmission speeds, which would result in these active circuit traces emanating electrical influences on other circuit traces nearby. The circuit traces nearby would undergo adverse changes in electrical impedance, affecting the speed and the attenuation of signals being transmitted thereby.

Because the emanations from active circuits would be less detrimental to other circuit traces if the other circuits were out of range of the emissions, the active circuit traces are spaced generous distances apart from the other circuit traces. The active circuits need to be spaced apart farther than the spacing between densely spaced terminals of the dual readout SIMM socket. Such active circuit traces are intolerant of such dense spacing of the terminals, especially when other circuit traces are routed to adjacent terminals of the dual readout SIMM socket.

The latest advances of the SIMM has required the use of individual wires soldered to the active circuit traces and connecting the wires to a wire receiving connector for mounting on a circuit card on which the dual readout SIMM socket is mounted.

SUMMARY OF THE INVENTION

The invention is developed with a recognition that the contacts of the dual readout SIMM socket will not accommodate the spacing requirements of the relatively widely spaced apart, active circuit traces. The present invention further recognizes that the SIMM has outgrown the dual readout SIMM, and results in an auxiliary connector and a connector system that uses the dual readout SIMM socket, and embodies changes of the system to an auxiliary connector.

The invention resides in an auxiliary, second connector and a socket system of which the auxiliary, second connector is a part. The socket system comprises, first and second sockets for receiving a circuit panel having circuit traces thereon, each socket having multiple electrical terminals in terminal receiving slots for engaging circuits on both sides of the circuit panel, the slots of the first socket being relatively densely spaced, the slots of the second socket being relatively widely spaced as compared to the slots of the first socket, and the first and second sockets having panel receiving slots in longitudinal alignment with one another to receive a circuit panel on which first circuit traces that are tolerant of relatively dense spacing are routed on the circuit panel for alignment with the relatively densely spaced slots of the first socket, and second circuit traces that are intolerant of relatively dense spacing with other circuit traces are relatively widely spaced, and are routed on the circuit panel away from the first circuit traces for alignment with the relatively widely spaced slots of the second socket.

The invention will now be described by way of example with reference to the drawings in which;

DETAILED DESCRIPTION

Figure 1:
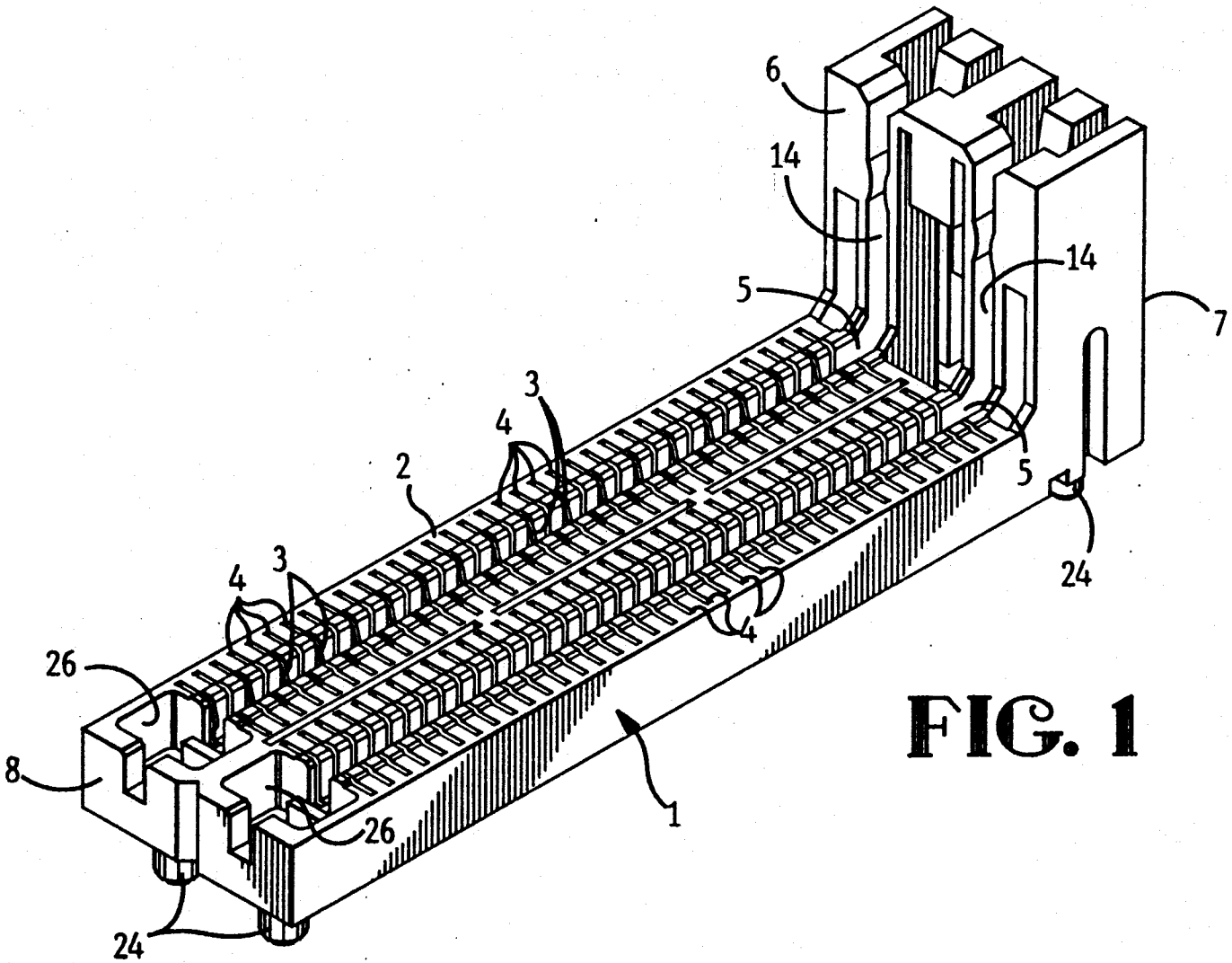
FIG. 1 is a perspective view of a auxiliary socket.
Figure 2:
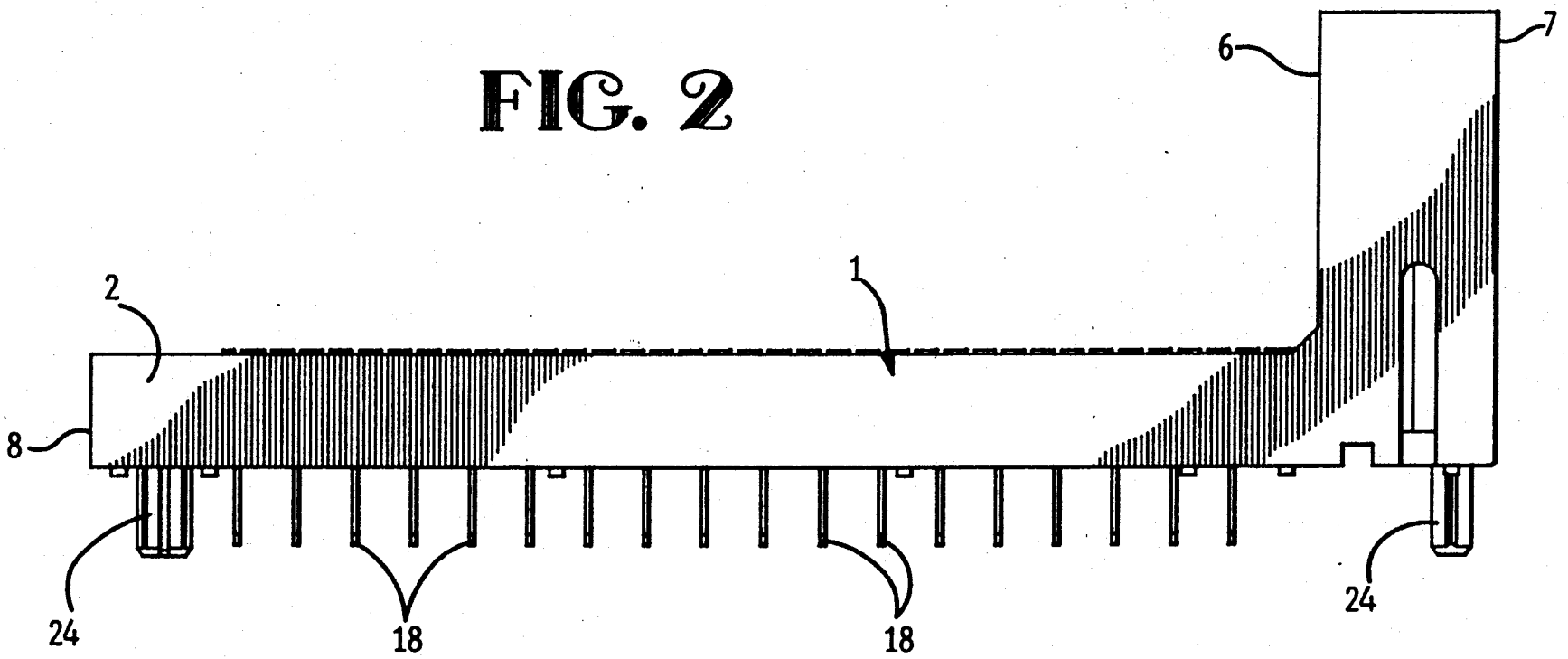
FIG. 2 is an elevation view of the socket shown in FIG. 1.
Figure 3:
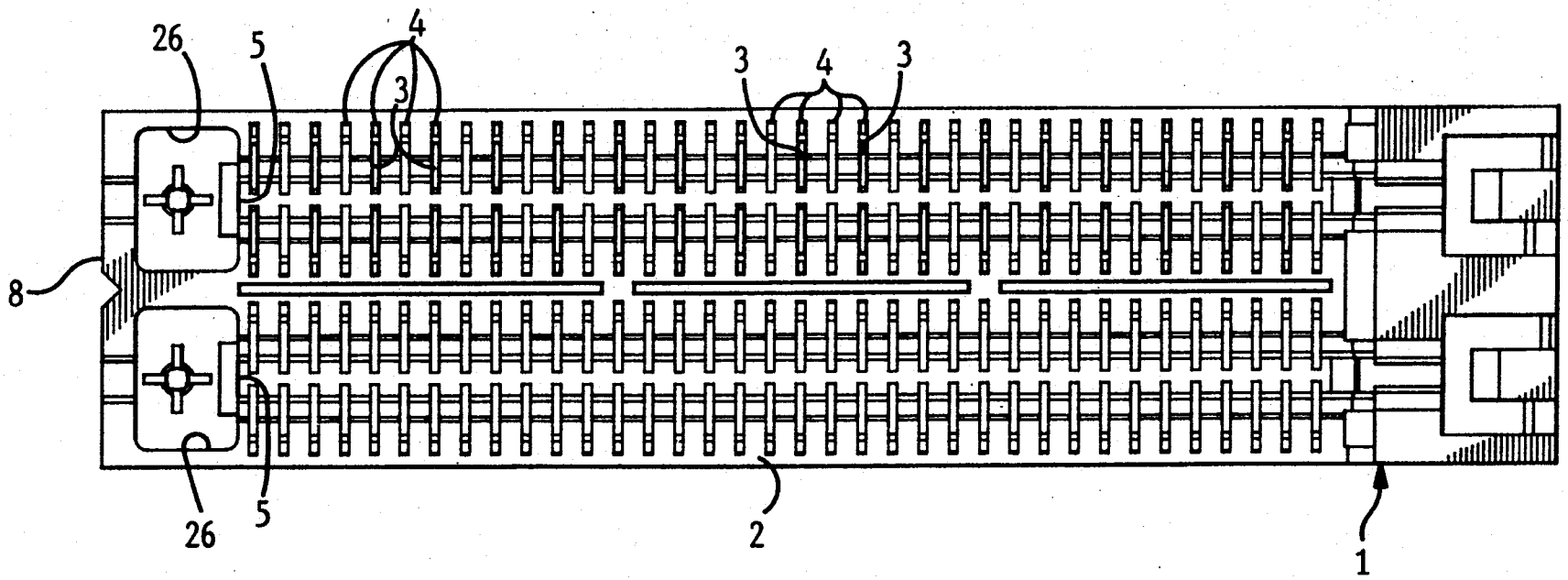
FIG. 3 is a plan view of the socket shown in FIG. 1.
Figure 4:
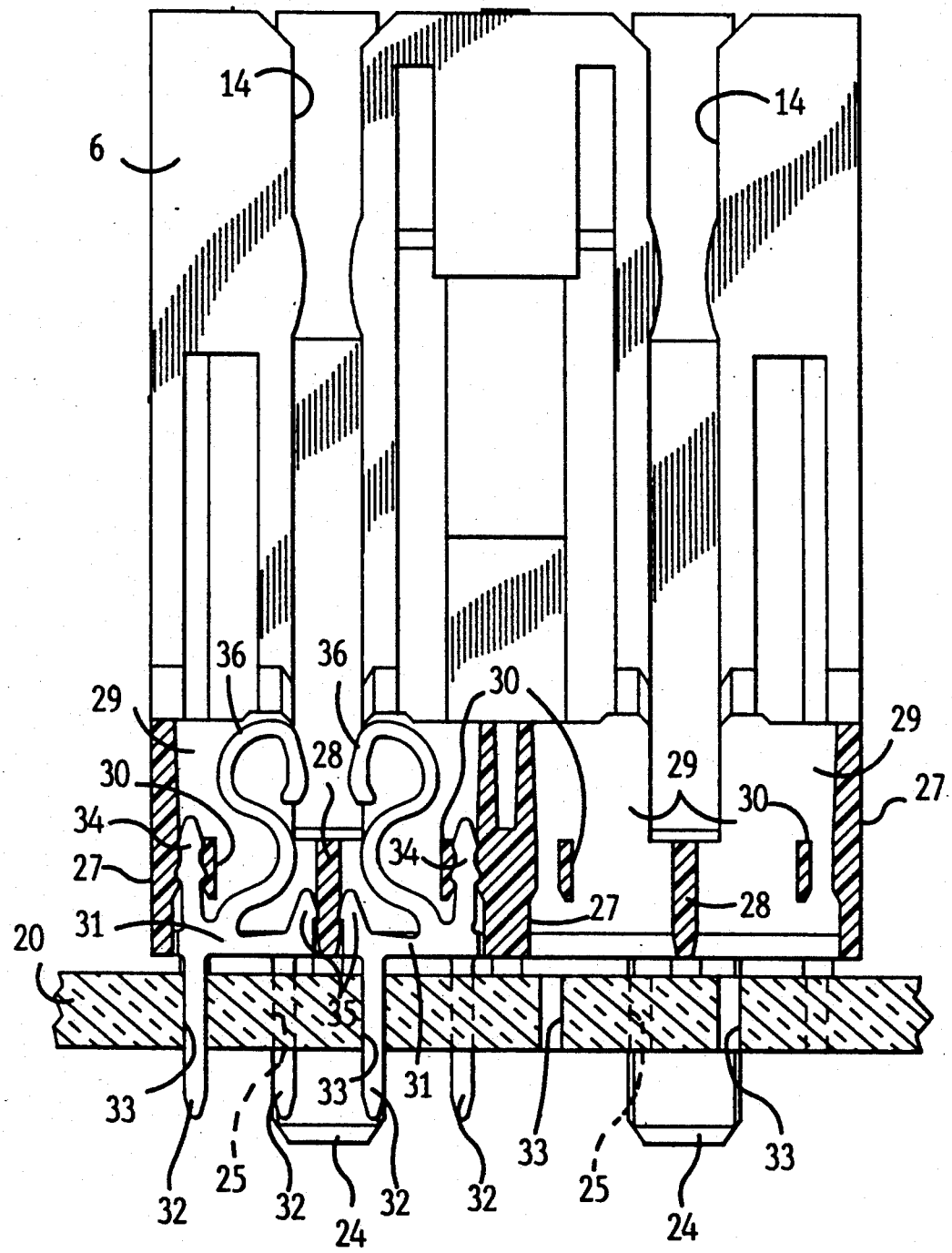
FIG. 4 is an end elevation view of the socket shown in FIG. 1 together with a portion of a circuit card, with parts broken away to illustrate details.

With reference to FIGS. 1 through 4, an auxiliary socket 1 comprises, an insulative housing 2 having multiple, conductive, electrical terminals 3, FIG. 4, in terminal receiving slots 4 intersecting opposite, long sides of respective, one or more, panel receiving slots 5 longitudinally extending in the housing 2. The auxiliary socket 1 further comprises, a panel support member 6 at one end 7 of the housing 2 projecting upwardly from each of the panel receiving slots 5. An opposite end 8 of the auxiliary socket 1 is adapted without a panel support member, such as the member 6, so as position the terminal receiving slots 4 relatively close to a main socket 9, FIG. 5.

Figure 5:
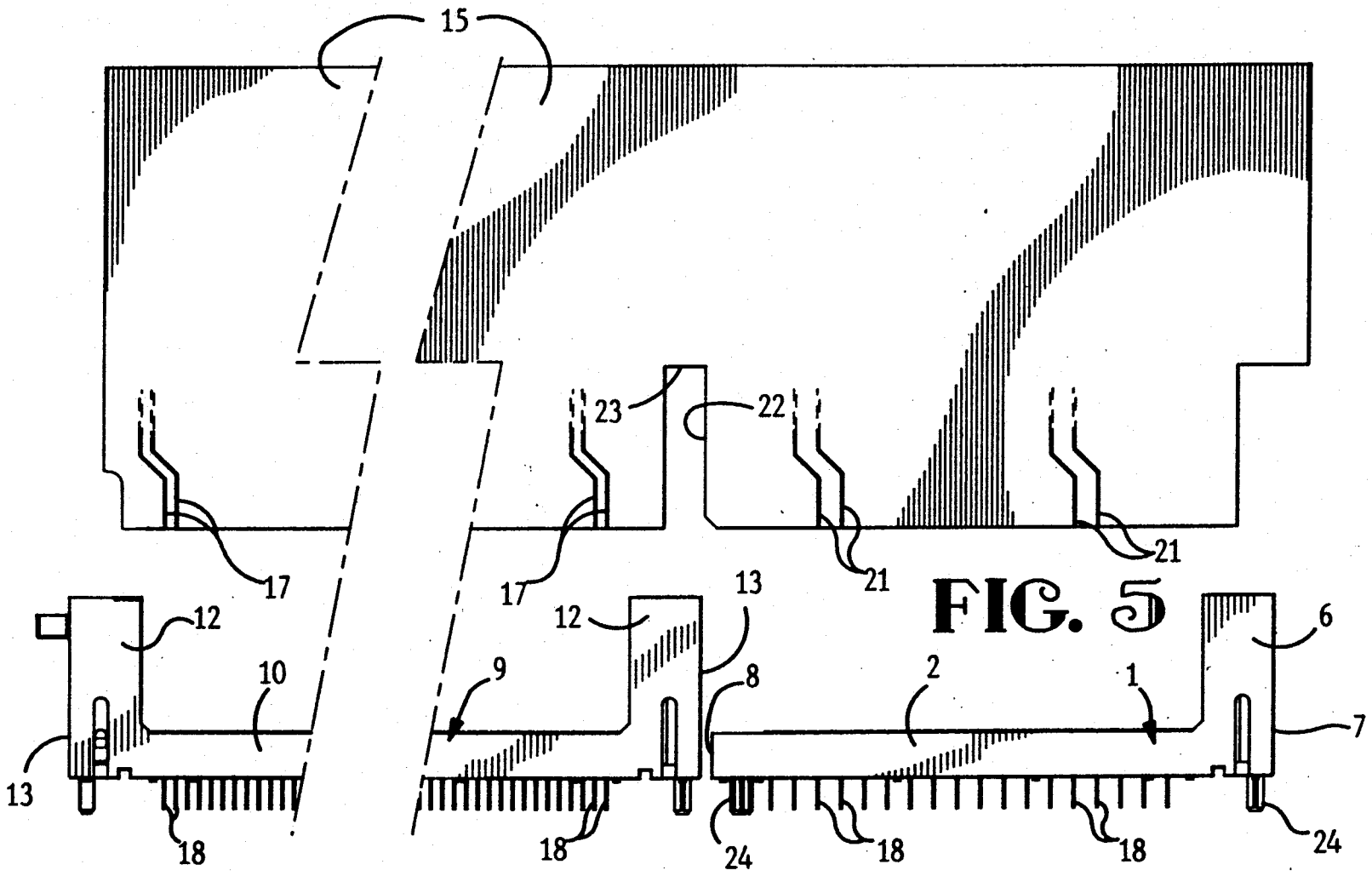
FIG. 5 is a fragmentary elevation view with parts broken away of the auxiliary socket shown in FIG. 1, together with a main socket and a circuit panel of a SIMM.
Figure 6:
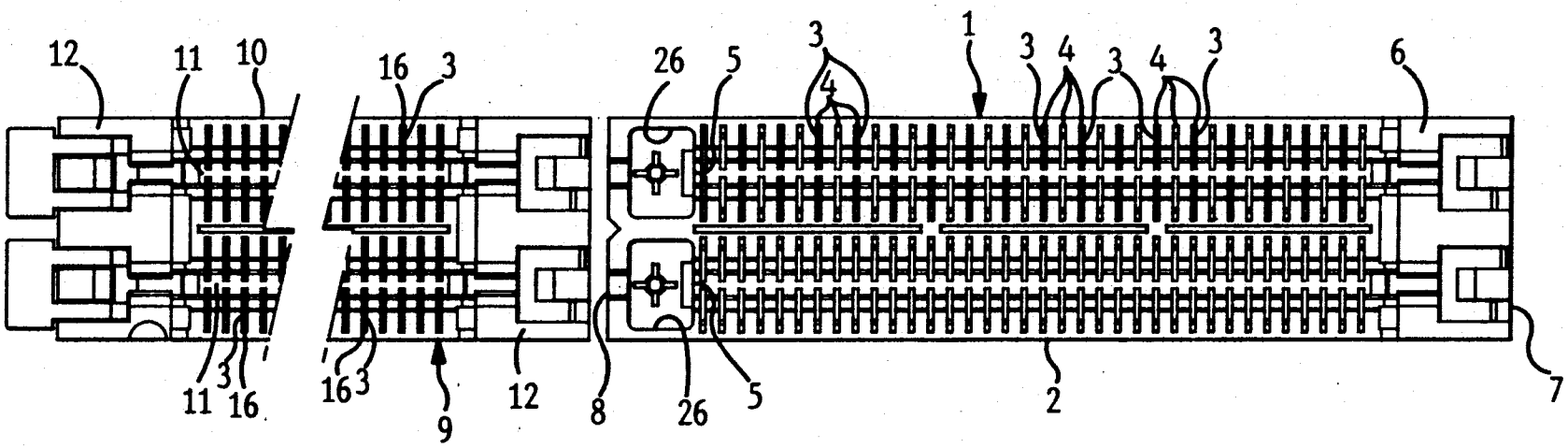
FIG. 6 is a fragmentary plan view of the structure shown in FIG. 5.

Further details of the main socket 9 are disclosed in U.S. patent application Ser. No. 572,196. The main socket 9 is a dual readout SIMM socket, comprising, FIG. 5, an insulative housing 10, panel receiving slots 11, panel support members 12, similar in construction to the post 6, at respective ends 13 of the housing 10, and each of two grooves 14 in the panel support members 3, 12 to receive and retain a corresponding circuit panel 15, particularly, a SIMM circuit panel. Electrical terminals 3, duplicates of the terminals 3, are in terminal receiving slots 16, and intersect and project into the panel receiving slots 11 for engaging circuit traces 17 on both sides of a circuit panel 15. As shown in FIG. 5, the terminals 3 have depending electrical leads 18 projecting downwardly from the housing 10 for insertion and solder connection in holes 19 of a circuit card 20 on Which the main socket 9 and the auxiliary socket 1 are mounted. The terminals 3 are in adjacent terminal receiving slots 16. As shown in FIGS. 5 and 6, adjacent terminal receiving slots 16 are relatively densely spaced apart, with adjacent slots 16 on a 0.050 inch (1.27 mm.) center line spacing, for example.

In the auxiliary socket 1, FIG. 5, duplicate ones of the electrical terminals 3 in the terminal receiving slots 4 intersect and project into the corresponding panel receiving slot 5 for engaging circuit traces 21 on both sides of the circuit panel 15, FIG. 5. The terminal receiving slots 4 are relatively densely spaced apart, with adjacent terminal slots 4 on a 0.050 inch (0.127 mm.) center line spacing, for example. The terminals 3 are in less than all of the terminal receiving slots 4, so as to be relatively widely spaced apart, especially as compared with the terminals 3 of the main socket 9. This is illustrated in FIG. 5, wherein the electrical leads of the terminals 3 in the auxiliary socket 1 are more widely spaced apart than the leads of the terminals 3 in the main socket 1. For example, the terminals 3 are in alternate ones of the slots 4, so as to be spaced apart on 0.10 inch (0.254 mm.) centerline spacing. Each panel receiving slot 5 is adapted for longitudinal alignment with the main socket 9 to receive a portion 22 of a corresponding circuit panel 15 projecting away from the main socket 9, and on which the circuit traces 21 that are intolerant of relatively dense spacing with other circuit traces 17 are routed on the portion 22 of the circuit panel 15 in relatively widely spaced alignment corresponding with the alignment of the relatively widely spaced terminals 3.

The main socket 9 has one of the panel support members 12 projecting upwardly to engage in a notch 23 of the corresponding panel 15. The portion 22 of the panel 15 extends past the notch 23 and along a corresponding panel receiving slot 5 of the auxiliary socket 1. The circuit traces 21 that are intolerant of relatively dense spacing with other circuit traces 17 extend along said portion 22 of the panel 15 that projects beyond an end 13 of the main socket 9 and into the panel receiving slot 5 of the auxiliary socket 1, wherein they are in alignment with the terminals 3 of the auxiliary socket 1.

The housing 2 of the auxiliary socket 1 further comprises, depending mounting posts 24 for insertion into apertures 25 of the circuit card 20, FIG. 4. To facilitate unitary formation of the mounting posts 24 by molding, FIG. 1, the housing 2 comprises, at the end 8, a hollow core 26 extending downwardly toward each corresponding post 24.

The housing 2 of the auxiliary socket 1 is of unitary construction, FIG. 4, with the terminal receiving slots 4 being enclosed by longitudinal sidewalls 27 of the housing 2, centerwalls 28 extending longitudinally along the bottoms of the panel receiving slots 5, transverse walls 29 bridging between a corresponding centerwall 28 and a side wall 27 to partition the terminals 3 from one another, and terminal retaining bars 30 bridging across the terminal receiving slots 4 and between corresponding transverse walls 29 of the terminal receiving slots 4.

Each of the terminals 3 of the auxiliary socket 1, FIG. 4, is of unitary construction, for example, stamped and formed from a strip of metal, and comprising, a base section 31 from which depends an electrical lead 32 projecting downwardly from the housing 2 for insertion and solder connection in a corresponding plated through hole 33 of the circuit card 20, spaced retention posts 34, 3$ projecting upwardly from the base section 31, with one of the posts 34 for frictional retention between a corresponding bar 30 and sidewall 27, and with another of the posts 35 in forced engagement against a corresponding centerwall 28, and a resilient spring section 36 projecting upwardly from the base. The spring section 36 is doubly reversely curved, in an S shape, and provides an electrical spring contact extending into a corresponding panel receiving slot 5 to make resilient electrical contact with a corresponding circuit trace 21 of the circuit panel 15. The terminal receiving slots 4 are on opposite sides of the panel receiving slot 5, and the terminals 4 on one side of the panel receiving slot 5 are electrically independent of the terminals 3 on the other side of the panel receiving slot 5.

The terminals 3 of the auxiliary socket 1 and of the main socket 9 are duplicates of one another for permitting the circuit traces 17, 21 of the circuit panel 15 to be adapted with the same design and engineering considerations for connection to respective terminals 3, whether the respective terminals 3 are of the auxiliary socket 1 or of the main socket 9. Further details of the terminals 3 are described in U.S. patent application Ser. No. 572,196.

We claim:

1. A socket system comprising: first and second sockets for receiving a circuit panel having circuit traces thereon, each socket having multiple electrical terminals in terminal receiving slots for engaging circuits on both sides of the circuit panel, the terminals of the first socket being relatively densely spaced, the terminals of the second socket being relatively widely spaced, and the first and second sockets having panel receiving slots in longitudinal alignment with one another to receive a circuit panel on which first circuit traces that are tolerant of relatively dense spacing are routed on the circuit panel for alignment with the relatively densely spaced terminals of the first socket, and second circuit traces that are intolerant of relatively dense spacing with other circuit traces are relatively widely spaced, and are routed on the circuit panel away from the first circuit traces and into alignment with the relatively widely spaced terminals of the second socket, the first socket has a panel support member projecting upward from the panel receiving slot, and an end of the second socket is adjacent the first socket, and is adapted without a panel support member so as to position the terminal receiving slots thereof relatively close to the panel support member of the first socket.

2. A socket system as recited in claim 1, wherein, terminals of the first and second sockets are duplicates of one another for permitting the circuit traces of the circuit panel to be adapted the same for connection to respective terminals, whether the respective terminals are of the first socket or of the second socket.

3. A socket system as recited in claim 1, wherein, the second socket has a panel support member projecting upwardly from the panel receiving slot, at least one depending mounting post at an end of the second socket being adjacent the first socket, and a hollow core extending downwardly toward the post to facilitate unitary formation of the post with the second socket.

4. A socket system as recited in claim 1, wherein, the terminal receiving slots of the first socket are on opposite sides of the panel receiving slot, and the terminals on one side of the panel receiving slot are electrically independent of the terminals on the other side of the panel receiving slot.

5. A socket system as recited in claim 1, wherein, the terminal receiving slots of the second socket are relatively densely spaced, and the terminals of the second socket are received in alternate ones of the terminal receiving slots.

6. A socket system as recited in claim 1, wherein the first socket has a panel support member projecting upwardly to engage in a notch of the panel, and a portion of the panel extends past the notch and along the panel receiving slot of the second socket, and the second circuit traces that are intolerant of relatively dense spacing with other circuit traces extend along said portion of the panel in alignment with the terminals of the second socket.

7. A socket system as recited in claim 1, wherein, the second circuit traces extend along a portion of the circuit panel that projects beyond an end of the first socket and into the panel receiving slot of the second socket.

8. A socket system as recited in claim 1, wherein, the circuit panel has a notch receiving a panel support member projecting upwardly from the first socket, and the second circuit traces extend along an extended portion of the circuit panel projecting beyond the notch and into the panel receiving slot of the second socket.

9. A socket system as recited in claim 1, wherein, the terminal receiving slots are relatively densely spaced apart, and the terminals are in less than all of the terminal receiving slots so as to be relatively widely spaced apart.

10. An auxiliary socket for use with a main socket adapted for receiving a portion of a circuit panel having circuit traces thereon, the auxiliary socket comprising: a housing having multiple electrical terminals in terminal receiving slots for engaging circuits on both sides of the circuit panel, the terminals being relatively widely spaced apart as compared to the terminals of the main socket, and a panel receiving slot adapted for longitudinal alignment with the main socket to receive a portion of a circuit panel projecting away from the main socket, and on which circuit traces that are intolerant of relatively dense spacing with other circuit traces are routed on the portion of the circuit panel into relatively widely spaced alignment corresponding with the alignment of the relatively widely spaced terminals, a panel support member projecting upwardly from one end of the auxiliary socket for supporting the circuit panel, and an opposite end of the auxiliary socket being adapted without a panel support member so as position the terminal receiving slots thereof relatively close to the main socket.

11. An auxiliary socket as recited in claim 10, wherein, the terminal receiving slots are relatively densely spaced apart, and the terminals are in less than all of the terminal receiving slots so as to be relatively widely spaced apart.

12. An auxiliary socket as recited in claim 10, and further comprising: at least one depending mounting post at an end of the second socket being adjacent the first socket, and a hollow core extending downwardly toward the post to facilitate unitary formation of the post with the second socket.

* * * * *